US006832867B2

(12) United States Patent
Sandbach et al.

(10) Patent No.: US 6,832,867 B2
(45) Date of Patent: Dec. 21, 2004

(54) FABRIC TREATMENT APPLICATOR

(75) Inventors: David Roy Sandbach, Overijse (BE); Jean Wevers, Steenhuffel (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/041,169

(22) Filed: Jan. 8, 2002

(65) Prior Publication Data

US 2002/0090251 A1 Jul. 11, 2002

(51) Int. Cl.[7] ..... B03C 1/02; B03C 9/06; B03C 17/00

(52) U.S. Cl. ..... 401/17; 401/34; 401/196; 401/198

(58) Field of Search ..... 401/17, 34, 198, 401/196

(56) References Cited

U.S. PATENT DOCUMENTS

| | | | | |
|---|---|---|---|---|
| 3,628,876 A | * | 12/1971 | Casey et al. | 401/198 |
| 3,748,268 A | | 7/1973 | Loudas | |
| 3,953,753 A | | 4/1976 | Barrett, Jr. et al. | |
| 4,273,661 A | | 6/1981 | Grey | |
| 4,842,762 A | | 6/1989 | Sabol, Jr. et al. | |
| 4,911,860 A | | 3/1990 | Van Den Brom | |
| 5,122,158 A | | 6/1992 | Kuroda et al. | |
| 5,259,848 A | | 11/1993 | Terry et al. | |
| 5,284,597 A | | 2/1994 | Rees | |
| 5,288,420 A | | 2/1994 | Mandy | |
| 5,324,131 A | | 6/1994 | Gardner, III | |
| 5,370,919 A | | 12/1994 | Fieuws et al. | |
| 5,611,687 A | | 3/1997 | Wagner | |
| 5,662,827 A | | 9/1997 | Steiger et al. | |
| 5,728,669 A | | 3/1998 | Tyerech | |
| 5,731,276 A | | 3/1998 | Argo et al. | |
| 5,765,407 A | | 6/1998 | Choo et al. | |
| 5,853,430 A | * | 12/1998 | Shindo et al. | 8/137 |

(List continued on next page.)

FOREIGN PATENT DOCUMENTS

| | | | | |
|---|---|---|---|---|
| DE | 24 22 191 | | 11/1975 | |
| DE | 195 36 714 | | 4/1997 | |
| EP | 0 157 653 | | 10/1985 | |
| EP | 0 205 999 | | 12/1986 | |
| EP | 0 266 200 | | 5/1988 | |
| EP | 0 318 470 | | 5/1989 | |
| GB | 1 016 053 | | 1/1966 | |
| JP | 10099769 | | 4/1998 | |
| WO | WO 85/00782 | | 2/1985 | |
| WO | WO 93/01348 | | 1/1993 | |
| WO | WO 95/34630 | | 12/1995 | |
| WO | WO 97/20099 | | 6/1997 | |
| WO | 98/00507 | * | 1/1998 | 510/311 |
| WO | WO 99/02769 | | 1/1999 | |

OTHER PUBLICATIONS

Helmac Stain Eraser—Instant Spot Remover (Product Label) Helmac Products Corporation, Alpharetta, GA.

McCrea, Bridget—"The Orange Glo Story"—Response Magazine, The Voice of the Electronic Retailing Association—Dec. 2001.

www.folex.net/index. html—"Folex Instant Carpet Spot Remover"—Sep. 10, 2002.

Google Search / Folox Carpet Cleaner—Sep. 10, 2002.

Google Groups / Newsgrups, Jan. 12, 1996—Tomato Soup Stain Removal from Carpet.

*Primary Examiner*—Gene Mancene
*Assistant Examiner*—Kathleen J. Prunner
(74) *Attorney, Agent, or Firm*—Jeffrey V. Bamber; Armina E. Matthews; Kim William Zerby

(57) ABSTRACT

An applicator for a fabric treatment composition and application thereof. Fabric treatment applicators comprising a nib and a containing a composition with a bleach and a surfactant and methods of use therefore. Portable stain remover applicator for a fabric treatment composition containing a housing and an application device that incorporates a nib herein the composition comprises at least one bleach and at least one surfactant.

9 Claims, 1 Drawing Sheet

U.S. PATENT DOCUMENTS 5,872,090 A 2/1999 You et al.
5,895,504 A 4/1999 Sramek et al.
6,048,368 A 4/2000 Tcheou et al.
6,059,477 A * 5/2000 Dunlap, Jr. et al. ..... 401/198 X
6,074,705 A 6/2000 DeBaene
6,179,501 B1 * 1/2001 Fulop ..... 401/34
6,283,933 B1 9/2001 D'Alessio et al.
6,294,511 B1 9/2001 Argo et al.
6,386,781 B1 * 5/2002 Gueret ..... 401/198
6,551,000 B2 4/2003 Kandasamy et al.
6,644,879 B2 11/2003 Irvin et al.
2002/0090251 A1 7/2002 Sandbach et al.
2002/0091070 A1 7/2002 Englisch et al.
2002/0178511 A1 12/2002 Goldoni et al.
2002/0198126 A1 12/2002 Irvin et al.
2003/0019046 A1 1/2003 Boissie et al.

* cited by examiner

FABRIC TREATMENT APPLICATOR

FIELD OF THE INVENTION

The present invention relates to an applicator for a fabric treatment composition and its application. More specifically the invention relates to a convenient to carry fabric treatment applicator comprising a nib for application and a fabric treatment composition comprising a surfactant and a peroxide bleach.

BACKGROUND OF THE INVENTION

Portable stain removers for a liquid composition, for pre laundry application, post laundry application or application on fresh stains, are known articles of manufacture. Similarly, portable applicators for the application of other liquid compositions are known, for example in the field of ink removal. Prior art in this field includes the following documents:

U.S. Pat. No. 5,288,420 discloses a stain removal composition provided in form of a solid stick, which can be applied to selected areas of a fabric in laundry preparations. Various compositions are disclosed comprising surfactants, enzymes and glycols. U.S. Pat. No. 3,748,268 discloses a stain removal composition especially for carpets and upholstery comprising a surfactant for an aerosol formulation. EP 0 205 999 discloses the provision of a laundry preparation composition in the form of a solid stick. WO 85/00782 discloses a kit comprising coloured fluids and an eradicator for these fluids, which can be used on various materials including clothing. DE 2422191 discloses a solution to be used on stains provided in an applicator with a felt insert. DE 19536714 discloses an applicator for a stain removal fluid which takes the form of a pen. WO 99/02769 discloses an impregnated towelette to clean stains from clothes and upholstery, comprising surfactant.

None of the above fabric treatment compositions comprises bleach. Moreover, these patents do not give details how the various applicators should be used.

Applicators comprising bleach are known in fields other than fabric treatment: U.S. Pat. No. 5,324,131 discloses an applicator for a liquid bleaching agent to be used to eradicate or remove an emphasising ink. The applicator may be provided with a felt tip or roller. U.S. Pat. No. 5,611,687 discloses an oral fluid, e.g. for the teeth or the gum, and an applicator for it comprising a broad fibre tip or a roller ball.

Prior art documents which address the application of the respective compositions in some detail include the following documents:

U.S. Pat. No. 5,765,407 describes an on-the-spot stain removal kit, comprising four sponges, and teaches a four step stain removal procedure for satisfactory results.

U.S. Pat. No. 5,122,158 discloses an applicator for an enzyme-containing liquid detergent for the application in laundry preparation. The applicator comprises a porous body made of a synthetic plastic material. The heat resulting from the friction produced by the applicator during application to a fabric is assumed to contribute to a more rapid enzymatic reaction.

Fabric treatment applicators which comprise bleach and surfactant are known from the following documents:

WO 97/20099 discloses an applicator for the post-laundry treatment of fabrics comprising bleach and surfactant. The applicator is designed for in-house use, in a preferred embodiment comprising an open channel for liquid delivery. A two step process is taught which involves the use of an iron on one side of the fabric and the use of an absorbent layer on the other side of the fabric. The application of heat and/or pressure by means of an iron is believed to affect the physical characteristics of the stained fabric, such as its viscosity.

U.S. Pat. No. 5,872,090 discloses a stamp like applicator for a fabric treatment composition comprising bleach and surfactant, which is to be applied to a fabric in a rocking motion. The treatment is preferably done on a table top and preferably using an absorbent stain remover situated beneath the fabric and followed by a post treatment process in a hot air cloth dryer.

EP 0 157 653 discloses a dual chambered container, comprising in one preferred embodiment a bottle with a laundry detergent comprising a bottle cap with a container for a bleach prespotter.

In view of the above prior art it remains a challenge to provide an efficient stain removal applicator, especially for convenient transport and immediate application to fresh stains, which is also suitable for some very delicate fabrics.

It is hence a main objective of the present invention to provide an applicator for a fabric treatment composition, which allows effective mechanical stain removal.

It is a further main objective of the present invention to provide an applicator for a fabric treatment composition, which can be successfully used on a large variety of stains and fabrics.

It is a further objective of the present invention to provide an applicator for a fabric treatment composition, which is easy to use.

It is another objective of the present invention to provide an applicator for a fabric treatment composition, which is convenient to store and to carry.

It is yet another objective of the present invention to provide an applicator for a fabric treatment composition, which does not dry out when stored over extended periods of time.

It is yet a further objective of the present invention to provide an applicator for a fabric treatment composition, which allows single step application.

It is yet even a further objective of the present invention to provide an applicator for a fabric treatment composition, which has self cleaning properties.

It is still an additional objective of the present invention to provide an applicator for a fabric treatment composition, which does not leave residues even when no rinsing or other post treatment of the fabric is undertaken.

These and other objectives, as apparent from the following description, are addressed by the present invention.

SUMMARY OF THE INVENTION

The present invention relates to an applicator for a fabric treatment composition and its application. More specifically the invention relates to a versatile convenient to carry and to apply fabric treatment applicator. Claimed and described is an applicator comprising nib 10 and further comprising a fabric treatment composition comprising bleach and surfactant.

BRIEF DESCRIPTION OF THE DRAWINGS

It is believed that the invention will be better understood from the foregoing description in conjunction with the following drawings.

DETAILED DESCRIPTION OF THE INVENTION

Figure 1:
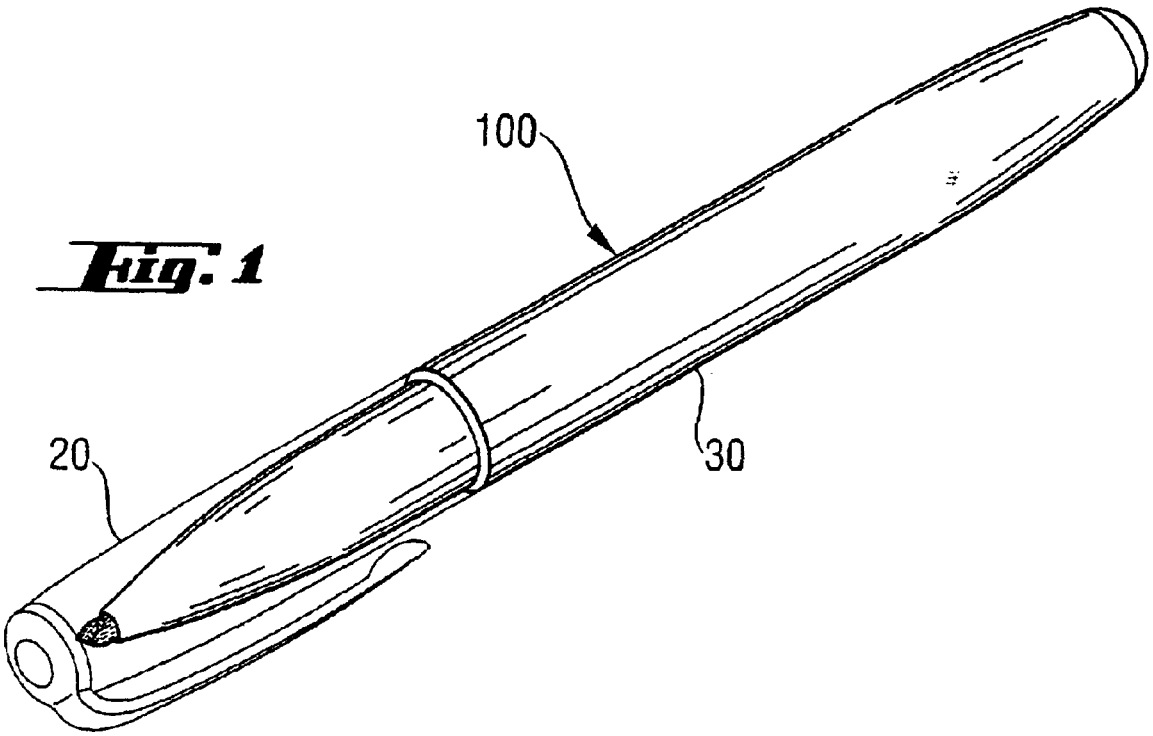
FIG. 1 is a perspective view of a fabric treatment applicator according to the present invention.

The present invention combines an advantageous fabric treatment applicator with an advantageous fabric treatment composition. According to the present invention the fabric treatment applicator comprises a nib 10. The preferred fabric treatment composition comprises bleach and surfactant.

It has now been found that superior fabric treatment and particularly stain removal can be achieved by effective mechanical stain removal in combination with effective chemical stain removal. According to the present invention effective mechanical stain removal is accomplished by the incorporation of a nib 10 into the fabric treatment applicator. This allows the use of fabric friendly chemical compounds at low levels, thus making the present invention suitable also for delicate fabric including silk.

In another aspect of the present invention the fabric treatment applicator has been found to have self cleaning properties. The nib 10 if present in a conventional fabric treatment applicator tends to acquire dirt and stain material stemming in particular from treated stains. Such stain material is potentially redeposited onto fabrics treated later. As has now been found such stain material can be effectively removed and/or made less visible by incorporating a bleach into the fabric treatment composition. This largely improves the functioning, aesthetic appearance and consumer acceptance of the fabric treatment applicator.

Preferred Fabric Treatment Compositions

Fabric treatment compositions according to the present invention comprise a bleach and a surfactant. They may also comprise numerous other components as listed below. Importantly, the fabric treatment compositions are optimised to leave minimal residues.

One problem associated with known fabric treatment compositions hereinafter referred to as stain removal compositions is their tendency to leave visible residues on fabric surfaces. Such residues are problematic and are preferably to be avoided herein since the present process does not involve conventional immersion or rinse steps. Accordingly, the stain removal compositions herein should, most preferably, be substantially free of various polyacrylate-based emulsifiers, polymeric anti-static agents, inorganic builder salts and other residue-forming materials, except at low levels of 0.1%–0.3%, and preferably 0%, of the final compositions (%, as used herein, denotes % by weight of 100% active). Water used in the compositions should preferably be distilled, deionized or otherwise rendered free of residue-forming materials.

Accordingly, in a preferred aspect of this invention there are provided stain removal compositions which are substantially free of materials which leave visible residues on the treated fabrics. This necessarily means that the preferred stain removal compositions are formulated to contain a high level of volatile materials, preferably water, preferably 95%, a cleaning solvent such as BPP at a low, but effective, level, typically 1% to 4%, preferably 2%, hydrogen peroxide at a level from 1% to 3%, preferably 2%, and surfactant at levels of 0.1% to 1%. Advantageously, when thus formulated such compositions exist as phase-stable aqueous solutions rather than as suspensions or emulsions. Thus, such compositions do not require use of additional emulsifiers, thickening agents, suspending agents, and the like, all of which can contribute to the formation of undesirable visible residues on the fabric.

Indeed, as an overall proposition, the chemical compositions which are used to provide the stain removal and the overall cleaning and/or refreshment functions herein comprise ingredients which are safe and effective for their intended use, and, as noted above, do not leave unacceptable amounts of visible residues on the fabrics. While conventional laundry detergents are typically formulated to provide good cleaning on cotton and cotton/polyester blend fabrics, the compositions herein must be formulated to also safely and effectively clean and refresh fabrics such as wool, silk, rayon, rayon acetate, and the like. In addition, the compositions herein comprise ingredients which are specially selected and formulated to minimize dye removal or migration from the stain site of fugitive, unfixed dye from the fabrics being cleaned. The preferred compositions herein are formulated to minimize or avoid these problems.

The dye removal attributes of the present compositions can be compared with art-disclosed cleaners using photographic or photometric measurements, or by means of a simple, but effective, visual grading test, the dye removal test described below.

In addition to the foregoing considerations, the compositions used herein are preferably formulated such that they are easily dispensed and not so viscous or self-adhesive in nature that they render the stain removal applicator unhandy or difficult to use. Preferably the fabric treatment compositions described herein are formulated as liquid fabric treatment compositions. In one alternative they may be provided as a gel. A stain removal composition according to the present invention comprises:

(a) Bleach—The compositions herein comprise from 0.001% to 99.99%, preferably 0.001% to 7%, by weight, of bleach, preferably peroxide bleach, most preferably hydrogen peroxide. More preferred spot cleaners will comprise 0.5% to 3% hydrogen peroxide. It will be appreciated that peroxide sources other than $H_2O_2$ can be used herein. Thus, various per-acids, per-salts, per-bleaches and the like known from the detergency art can be used. However, such materials are expensive, difficult to formulate in liquid products, can leave residues on fabrics and offer no special advantages over $H_2O_2$ when used in the present manner.

(b) Surfactant—The compositions herein comprise from 0.001% to 99.99%, preferably 0.05% to 5%, more preferably 0.05% to 2% by weight of surfactants, such as ethoxylated alcohols or alkyl phenols, alkyl sulfates, NaAES, NH4AES, amine oxides, and mixtures thereof. As noted above, use of surfactants limited to the lower end of the range is preferred for some dyes and fabric types. Typically, the weight ratio of BPP solvent:surfactant(s) is in the range of from about 10:1 to about 1:1. One preferred composition comprises 2% BPP/0.8% AES. Also, nonionics such as the ethoxylated C10–C16 alcohols, e.g., NEODOL 23-6.5, can be used in the compositions. The alkyl sulfate surfactants which may be used herein as cleaners and to stabilize aqueous compositions are the C8–C18 primary ("AS"; preferred C10–C14, sodium salts), as well as branched-chain and random C10–C20 alkyl sulfates, and C10–C18 secondary (2,3) alkyl sulfates of the formula CH3(CH2)×(CHOSO3-M+) CH3 and CH3 (CH2)y (CHOSO3-M+) CH2CH3 where x and (y+1) are integers of at least 7, preferably at least 9, and M is a water-solubilizing cation, especially sodium, as well as unsaturated sulfates such as oleyl sulfate. Alkyl ethoxy sulfate (AES) surfactants used herein are conventionally depicted as having the formula R(EO)×SO3Z, wherein R is C10–C16 alkyl, EO is —CH2CH2—O—, x is 1–10 and can include mixtures which are conventionally reported as averages, e.g., (EO)2.5, (EO)6.5 and the like, and Z is a cation such as sodium ammonium or magnesium (MgAES). The C12–C16 alkyl dimethyl amine oxide surfactants can also be used.

(c) Solvent—The compositions herein may comprise from 0% to 99.99% preferably from 0% to 10% by weight, of butoxy propoxy propanol (BPP) solvent or other solvents as described herein. Organic solvents are preferred for use in the present compositions. Preferred spot cleaners will comprise 1–4% BPP which is available in commercial quantities as a mixture of isomers in about equal amounts. The isomers, and mixtures thereof, are useful herein. The isomer structures are as follows:

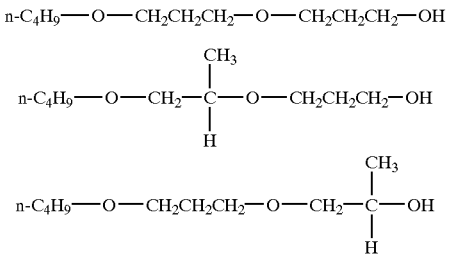

Other useful solvents are hydrotropes such as sodium toluene sulfonate and sodium cumene sulfonate, short-chain alcohols such as ethanol and isopropanol, and the like. They can be present in the compositions as only solvents or in combination with other solvents.

(d) Water—The preferred, low residue compositions herein may comprise from 0% to 99.99%, preferably from 70% to 99.99%, more preferably 90% to 99.9%, most preferably from 94.0% to 99.0%, by weight, of water and hence are preferably aqueous solutions. Water used in the compositions should preferably be distilled, deionized or otherwise rendered free of residue-forming materials.

(e) Other Optionals—The compositions herein may comprise minor amounts of various optional ingredients, including enzymes, preservatives, anti-static agents, fragrances, odor absorbing components, and the like. If used, such optional ingredients will typically comprise from 0.0001% to 10%, more preferably from 0.01% to 2%, by weight, of the compositions, having due regard for residues on the cleaned fabrics. Preferred optionals are namely the following:

Chelator—The chelating agent is selected from those which, themselves, are stable in aqueous $H_2O_2$ and which stabilize the $H_2O_2$ by chelating vagrant metal ions. Such chelating agents are typically already present at low, peroxide-stabilizing amounts (0.01%–1%) in commercial sources of hydrogen peroxide.

Enzymes—Besides the optional surfactants in the stain removal compositions herein can contain enzymes to further enhance cleaning performance. Lipases, amylases and protease enzymes, or mixtures thereof, can be used. If used, such enzymes will typically comprise from 0.001% to 5%, preferably from 0.01% to 1%, by weight, of the composition. Commercial detersive enzymes such as LIPOLASE, ESPERASE, ALCALASE, SAVINASE and TERMAMYL (all ex. NOVO) and MAXATASE and RAPIDASE (ex. International Bio-Synthesis, Inc.) can be used.

Preservatives—The compositions herein can optionally be preserved for storage using conventional preservatives such as KATHON® at a level of 0.0001%–1%, by weight.

Anti-static agents—If an antistatic benefit is desired, the compositions used herein can contain an anti-static agent. If used, such anti-static agents will typically comprise at least 0.5%, typically from 2% to 8%, by weight, of the compositions. Preferred anti-stats include the series of sulfonated polymers available as VERSAFLEX 157, 207, 1001, 2004 and 7000, from National Starch and Chemical Company Fragrances—The odor absorbing composition of the present invention can also optionally provide a "scent signal" in the form of a pleasant odor which signals the removal of malodor from fabrics. The scent signal is designed to provide a fleeting perfume scent, and is not designed to be overwhelming or to be used as an odor masking ingredient. When perfume is added as a scent signal, it is added only at very low levels, e.g., from 0% to 0.5%, preferably from 0.003% to 0.3%, more preferably from 0.005% to 0.2%, by weight of the usage composition.

Perfume can also be added as a more intense odor in product and on surfaces. When stronger levels of perfume are preferred, relatively higher levels of perfume can be added. Any type of perfume can be incorporated into the composition of the present invention.

Odor absorbing components—The compositions of the present invention may further comprise an optional cyclodextrin. This will impart the composition with odour absorbing properties, which is especially useful for application on inanimate surfaces to control the malodour.

As used herein, the term "cyclodextrin" includes any of the known cyclodextrins such as unsubstituted cyclodextrins containing from six to twelve glucose units, especially, alpha-cyclodextrin, beta-cyclodextrin, gamma-cyclodextrin and/or their derivatives and/or mixtures thereof. The preferred cyclodextrins are available, e.g., from Cerestar USA, Inc. and Wacker Chemicals (USA), Inc.

Typical levels of cyclodextrin in usage compositions for usage conditions are from 0.01% to 5%, preferably from 0.1% to 4%, more preferably from 0.2% to 2% by weight of the composition.

The preselected pH range of the stain removal compositions assists in stabilising the hydrogen peroxide present and is typically in the acid-slightly basic range from about 3 to about 8, preferably about 6.

A stain removal composition comprising water, surfactant and bleach is efficient in treating a large variety of stains. It is known that various greasy stains are best treated with a surfactant whereas other common stains as from grass, tomato sauce or wine are best treated with bleach, while water soluble stains can normally effectively removed with water.

While referring to stain removal compositions, the compositions disclosed herein may also favourably be used in other contexts, for example for bleaching and/or sanitation of non-stained fabrics.

Examples of Stain Removal Compositions

Having due regard to the foregoing considerations, the following illustrates preferred examples of stain removal compositions, but is not intended to be limiting thereof.

EXAMPLE 1

| | % (wt) of 100% active component formula range |
|---|---|
| BPP | 1.0–2.0 |
| Hydrogen peroxide | 1.5–3.0 |
| Alkyl sulfate surfactant | 0.3–1.0 |
| Perfume | 0.005–0.01 |
| Ethanol | 0.3–1.0 |
| EDTA | <0.01 |
| Water | Balance |

EXAMPLE 2

| | % (wt) of 100% active component formula range |
|---|---|
| BPP | 1.0–2.0 |
| Hydrogen peroxide | 1.5–3.0 |
| LIPOLASE | 0.3–0.5 |
| Alkyl sulfate surfactant | 0.3–1.0 |
| Perfume | 0.005–0.01 |
| Ethanol | 0.3–1.0 |
| EDTA | <0.01 |
| Water | Balance |

Applicators

Figure 2:
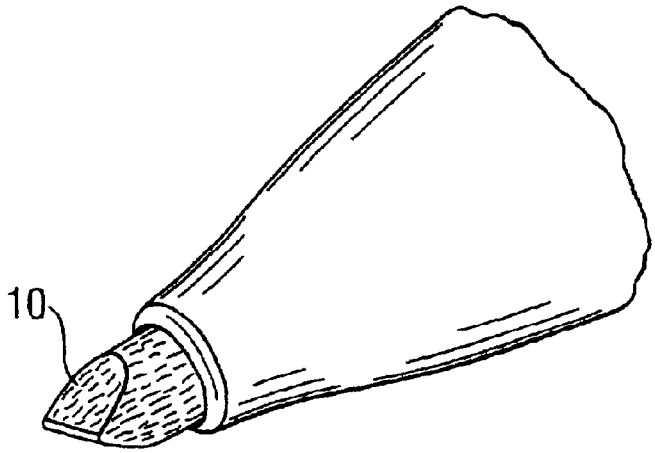
FIG. 2 is an enlarged view of the nib of the fabric treatment applicator according to FIG. 1.

Generally any applicator comprising a nib 10 is within the scope of the present invention. The choice of a particular applicator will largely depend on the usage envisaged. One preferred applicator is shown in FIGS. 1 and 2.

Such applicators comprise a housing 30 comprising a reservior for the storage of a composition. Such a housing 30 may be a bottle of any shape or size. Preferred shapes for such housings 30 are hollow barrel shapes, most preferably having a diameter to length ratio from 1:30 to 1:2, so as to be convenient to hold in the user's hand, use and store. More preferred are housings 30 of a diameter to length ratio from 1:20 to 1:5, which resemble in shape a pen, e.g. a ball point pen or a highlighter pen, and which are herein referred to as pen-shaped. The reservoir may be filled with an aborbent material, such as a wadding or a cartridge style device such as those commonly found in ink pens which is able release liquid on demand. The housing 30 may be made of any solid material, which may also be flexible, such as glass or any plastic material. A preferred material is polypropylene.

The housing 30 may have one or more application devices. The term application device, as used herein, is a device which in use is in contact with the surface on which the fabric treatment applicator is used and delivers the fabric treatment composition to that surface. According to the present invention at least one application device is a nib 10. Other preferred application devices include any sponge, or foam insert, for example in the form of a porous pad, for example made of felt or a non-woven material. Another preferred application device is a roller ball. Other preferred application devices are all those used to apply a writing fluid to paper. e.g. as used in a fountain pen. Applicators comprising no application device other than a nib are preferred.

In other applicator embodiments according to the present invention the housing may comprise more than one reservoir, preferably two, three or four reservoirs. Not all of these reservoirs need to comprise fabric treatment compositions which comprise a bleach and a surfactant. For example one reservoir may comprise a bleach or another heat-activatable compound and another reservoir may comprise a surfactant. Preferably the reservoir comprising a bleach does not comprise a surfactant and the reservoir comprising a surfactant does not comprise a bleach. Further reservoirs, if present, may comprise other fabric treatment compositions known in the art.

While each reservoir may be an integral part of the housing 30, in one preferred embodiment of the present invention the reservoirs are provided in the form of replaceable cartridges.

An applicator comprising such a plurality of reservoirs may comprise a single application device or a plurality of application devices. A plurality of reservoirs may be in liquid communication with a single application device and a plurality of reservoirs may each be in liquid communication with a single application device.

One preferred embodiment of the present invention is an applicator with two reservoirs and one application device. One of these reservoirs comprises a fabric treatment composition comprising bleach and the other reservoir comprises a fabric treatment composition comprising a surfactant but no bleach. Both are in liquid communication with the same application device, e.g. a nib 10.

Another preferred embodiment of the present invention is an applicator with two reservoirs and two application devices. One of these reservoirs comprises a fabric treatment composition comprising bleach and the other reservoir comprises a fabric treatment composition comprising a surfactant and no bleach. Each of the two reservoirs is in liquid communication with one of the two application devices. This allows to use the applicator selectively on different types of stains, but makes it unnecessary to carry more than one applicator.

The term nib 10 as used according to the present invention does not comprise nibs 10 which comprise a single opening or channel to deliver the fabric treatment composition. Such an opening or channel does not allow the delivery of the fabric treatment composition in a controlled manner as a nib 10. Hence, either insufficient composition will be delivered for effective cleaning or unnecessary large amounts of composition may be delivered, the latter leading to longer drying times for the treated fabric or in some cases possibly even to residues. Moreover, an opening or channel leading to the reservoir promotes the evaporation of volatile compounds of the composition stored therein and may induce leaking when the fabric treatment applicator is transported. The same disadvantages are associated with a porous application device, e.g. a porous pad. Hence, a nib 10 in accordance with the present invention has an average pore site of less than 300 $\mu$m. Preferably pores which may be present in the nib 10 according to the present invention have an average size from 1 $\mu$m to 200 $\mu$m, more preferably from 5 $\mu$m to 100 $\mu$m, more preferably from 10 $\mu$m to 50 $\mu$m.

Preferably the nib 10 is cone-shaped as defined below. A cone-shaped nib 10 allows the exertion of pressure on a relatively narrow area, which is beneficial for mechanical stain removal, without leading to damage of the nib 10, which is thicker and hence more stable closer to the housing 30. A cone-shaped nib 10 also enables the application of the fabric treatment composition to a small selected area as beneficial for low moistening of the fabric and low residues.

The term cone-shaped as used with regard to the nib 10 is to be understood from the following definitions: The centre of the contact area, defined as given below, is referred to as contact point. A line connecting this contact point with the centre of mass of the fabric treatment applicator defines a vertical axis. A horizontal cross section is a cross section along any plane perpendicular to the vertical axis. The horizontal cross section of the nib 10 which is closest to the housing 30, but does not comprise any portion of the housing 30 is referred to as rod cross section. The surface area of the nib in 10 in the rod cross section, referred to as rod area, is to be compared with the contact area of the nib 10. A nib 10 is cone-shaped if the contact area of the nib 10 is less than 80% of the rod area. For a preferred nib 10 the rod area is less than 60%, more preferably less than 40%, yet more preferably less than 20% of the rod area. The nib 10 may have any shape, cone style or 'wedge shape' being preferred for the nib 10. A particular preferred cone-shaped nib in 10 is wedge-shaped, as depicted in FIG. 2.

The nib 10 and any other application device should be in contact with the reservoir, directly or indirectly, so as to allow transfer of the fabric treatment composition to the nib 10 during use. The nib 10 may be made of any synthetic or man-made or natural materials such as felt, open cell foam, closed cell foams, polyethylene, nylon etc. A preferred material for the nib 10 is felt, most preferably provided from synthetic fibres. The nib 10 while being held by the housing 30 has a section external to the housing 30, this section preferably measures from 3.0 cm to 0.1 cm, more preferably from 1.0 cm to 0.25 cm, most preferably from 0.75 cm to 0.5 cm in length. Preferably the maximum diameter measured in the rod cross section of the nib 10 (as defined above) is from 1 mm to 20 mm, more preferably from 3 mm to 10 mm, most preferably from 5 mm to 8 mm.

The contact area—measured as given below—between the nib 10 and a flat surface preferably is from 0.25 $mm^2$ to 400 $mm^2$, more preferably from 1 $mm^2$ to 100 $mm^2$, most preferably from 4 $mm^2$ to 10 $mm^2$. Such a contact area optial mechanical stain removal and allows for application of the fabric treatment composition to small selected areas.

Preferred application devices according to the present invention exhibit a certain delivery volume efficiency—measured as described below. The delivery volume efficiency is defined as the amount of fluid (ml) delivered to the fabric per unit per unit area ($s^{-1}mm^{-2}$). The right delivery volume efficiency ensures that a sufficient but not high amount of fabric treatment composition is delivered giving the benefits of a sufficient and constant flow rate and further the benefit of avoiding drying out of the nib 10 or the reservoir in between uses. The delivery volume efficiency is preferably from 0.0005 ml $mm^{-2}$ $s^{-1}$ to 0.1 ml $mm^{-2}$ $s^{-1}$ and more preferably from 0.001 ml $mm^{-2}$ $s^{-1}$ to 0.01 ml $mm^{-2}$ $s^{-1}$.

The applicator may also comprise a cap 20 to prevent evaporation of the composition and to prevent any unattended contact of the nib 10 with objects when not used.

FIG. 1 shows an applicator 100 with a pen-shaped housing 30 comprising a cap 20. As best seen from FIG. 2 the nib 10 has a preferred wedge shape.

Preferred Methods of Application

The compositions disclosed herein may find usage on any surface of a material in direct or indirect contact with the human body, which inter alia are all encompassed by the term fabric. Those surfaces are typically soft surfaces comprised by materials such as soft plastic materials, leather and textile fabrics. Textile fabrics namely are found in clothing, including shirts, ties, blouses, socks, skirts, trousers, jackets, underwear, watch straps etc.

Moreover these compositions can be used on fabrics comprised by carpets, curtains or upholstery and the like.

The use of any applicator with any composition disclosed herein will depend on the applicator itself and also on the object on which the applicator is to be used.

For a fabric treatment applicator as shown in FIG. 1 comprising a housing 30 and an application device a cap 20 covering the application device, if present, is removed before application. The application device is then brought in contact with a selected area of an object. For some application device exertion of pressure may be needed to release the composition from the applicator. The pressure initially needed for this purpose may be higher than the pressure needed to keep up the flow of composition. Wiping or otherwise moving the application device over the selected application area way be required to deliver the composition to all parts of this area and way help to uniformly apply the composition. Rubbing, i.e. wiping while exerting pressure towards the object, may help in the mechanical removal of stains.

The application of any composition disclosed herein, may be one step of a more comprehensive treatment of an object, namely a fabric. For example, the application of a stain removal composition may be followed by the application of a pre-laundry composition, by laundry, or may be followed by a rinsing or drying step. A rinsing step may be carried out with a dedicated rinsing composition such as alcohol, glycol or pure water. However, due to the water content of the composition of the present invention such an additional rinsing step is normally not needed. A drying step may be a treatment with a dry or slightly moist wipe or an absorbent pad. However, a drying step is normally not needed, since the compositions disclosed herein promote quick drying and the applicators disclosed herein allow application to small areas.

Test Methods

Dye Removal Test

An expert panel assists in visual grading. Thus, in one such test, swatches of fabric are individually dyed with a dye from a representative dye category such as from reactive dyes, sulphur dyes, vat dyes, direct dyes and azoic dyes. A swatch of fabric is prepared with a dye from each category. A measured area within each swatch is treated with the fabric treatment composition and allowed to dry. Any dye removal in the treated swatch is assessed visually by comparing the treated area of the swatch with the surrounding untreated area of the swatch. Numerical units ranging from: (0) 'no difference between both fabrics', (1) 'I think there is a difference', (2) 'I'm sure there is a difference', (3) 'there is a big difference', (4) 'there is a huge difference' are assigned by panelists. The test is repeated three times of any swatch and an average value is calculated.

Measurement of Contact Area

Measurements of the contact area of the nib 10 are carried on with a fabric treatment applicator which contains a dry nib 10 and no treatment composition. The dry nib 10 is inked by pressing it against an ink stamp pad and then clamping the fabric treatment applicator to the load arm of a Plint dual axis reciprocating rig (such as model TE75R, MRPRA RUBBER CONSULTANTS). A mark an a contact surface which is representative of the contact area of the nib 10 is obtained by controlled lowering and raising of the Plint load arm towards and away front the contact surface. The angle of the fabric treatment applicator relative to the contact surface is adapted to maximise the contact area. Angles of the fabric treatment applicator relative to the contact surface for which the angle between the vertical axis of the fabric treatment applicator (as defined above) and the contact surface less than 45° are not considered (since they are not typical for a consumer preferred application method). The contact time should be approximately 1s while a 3N load should be applied on the nib 10. The contact area can then be calculated from the mean length and width of the mark determined using a magnifying lens with a graticule. Measurements with the nib 10 in final measuring position are repeated three times to check reproducibility.

Measurement of Delivery Volume Efficiency

The nib 10 is firmly inserted through th bottom of a standard liquid container (such as a 50 ml centrifuge tube available from Corning No. 25330-50). To ensure a secure arrangement, the size of the orifice through which the nib 10 is inserted is cut to the size of the nib 10 and a silicone based sealant used. This unit is then clamped into position beneath a compressor unit (such as a Lloyd LR5K Compression meter). This arrangement provides a consumer realistic vertical load of 3N. The nib 10 is placed in contact with an absorbent pad comprised of a bicomponent synthetic fibre top layer above a fluffy pulp base layer. The pad allows rapid transport away from the paint of delivery so as not to reduce the concentration gradient and hence reduce flow. The container is then filled with the stain removing solution (such as Example 1) to a level of 20 ml. The amount of fluid flows per unit time is measured by noting the loss of fluid from the reservoir over a fixed period. The delivery volume efficiency is then calculated by normalising the flow rate with respect to the total surface area of contact ($mm^2$) between the nib 10 and the fabric. Measurement are repeated three times to check reproducibility.

What is claimed is:

1. A fabric treatment applicator comprising (a) a pen-shaped housing;

(b) an application device comprising a nib which is held by said housing, said nib being made of felt provided from synthetic fibres and is wedge-shaped, said felt comprising pores in the size range of from 10 $\mu$m to 50 $\mu$m; and (c) a fabric treatment composition comprising from 0.001% to 99.99% bleach and from 0.05% to 5% surfactant stored within said housing.

2. An applicator according to claim 1 wherein the fabric treatment composition comprises from 0.5% to 3% bleach.

3. An applicator according to claim 1 wherein the fabric treatment composition further comprises from 70% to 99.9% water.

4. An applicator according to claim 3 wherein the fabric treatment composition further comprises butoxy propoxy propanol solvent.

5. An applicator according to claim 4 wherein the fabric treatment composition further comprises alkyl ethoxy sulfate surfactant.

6. An applicator according to claim 1 wherein the fabric treatment composition further comprises alkyl ethoxy sulfate surfactant.

7. A method of treating a fabric with a fabric treatment applicator according to claim 1, said method comprising the step of rubbing the nib on the fabric and exerting pressure towards the fabric.

8. A fabric cleaning applicator comprising;

a.) a housing containing a fabric treatment composition comprising a surfactant; and b.) at least two application devices, wherein at least one application device is a nib held by said housing, said nib being made of felt provided from synthetic fibers, said nib comprising pores in the size range of from 10 $\mu$m to 50 $\mu$m.

9. A fabric treatment applicator according to claim 8 wherein the fabric treatment applicator further comprises two reservoirs.

* * * * *